US006245175B1

(12) United States Patent
Hotta et al.

(10) Patent No.: US 6,245,175 B1
(45) Date of Patent: Jun. 12, 2001

(54) ANISOTROPIC CONDUCTIVE FILM AND PRODUCTION METHOD THEREOF

(75) Inventors: Yuji Hotta; Amane Mochizuki, both of Ibaraki (JP)

(73) Assignee: Nitto Denko Corporation, Tokyo (JP)

( * ) Notice: Subject to any disclaimer, the term of this patent is extended or adjusted under 35 U.S.C. 154(b) by 0 days.

(21) Appl. No.: 09/230,865

(22) PCT Filed: Aug. 6, 1997

(86) PCT No.: PCT/JP97/02750

§ 371 Date: Feb. 2, 1999

§ 102(e) Date: Feb. 2, 1999

(87) PCT Pub. No.: WO98/07216

PCT Pub. Date: Feb. 19, 1998

(30) Foreign Application Priority Data

Aug. 8, 1996 (JP) ..... 8-209542
May 7, 1997 (JP) ..... 9-117244

(51) Int. Cl.[7] ..... B65H 81/00

(52) U.S. Cl. ..... 156/172; 156/250; 29/878; 439/66; 439/591

(58) Field of Search ..... 156/169, 172, 156/184, 185, 187, 188, 193, 250; 439/66, 591; 29/877, 878

(56) References Cited

U.S. PATENT DOCUMENTS 3,852,878 12/1974 Munro ..... 29/629
5,364,276 * 11/1994 Inasaka ..... 439/66
5,460,677 * 10/1995 Inasaka ..... 156/174

FOREIGN PATENT DOCUMENTS 25 20 590 11/1975 (DE) .
0 469 798 A2 2/1992 (EP) .

* cited by examiner

*Primary Examiner*—James Sells
(74) *Attorney, Agent, or Firm*—Sughrue, Mion, Zinn, Macpeak & Seas, PLLC

(57) ABSTRACT

The object of the present invention to provide an anisotropic conductive film capable of establishing electrical connection at a narrow pitch, maintaining strength in the film surface direction that has not been achieved so far, and improving the adhesion to an objective substance, as well as a preferable production method thereof. At least one coating layer made from an insulating material is formed on a metal thin wire, the wire is wound around a core member, the wire is heated and/or pressurized to weld and/or pressure-weld the coating layers to each other to give a winding block, and the winding block is cut in a predetermined film thickness. In this way, an anisotropic conductive film, wherein conductive paths 2 (=metal thin wires) are insulated from each other and pierce a film substrate 1 in the thickness direction, can be obtained. When the coating layer consists of two layers, the outer layer thereof corresponds to the film substrate 1 and the inner layer corresponds to a coating layer 3. After slicing the winding block, the core member may be used as a product without removing.

18 Claims, 11 Drawing Sheets

1. film substrate
2. conductive path
3. coating layer
4. end of conductive path

ANISOTROPIC CONDUCTIVE FILM AND PRODUCTION METHOD THEREOF

TECHNICAL FIELD

The present invention relates to an anisotropic conductive film. More particularly, the present invention relates to an anisotropic conductive film that is preferably used for the connection between a semiconductor device and a substrate.

BACKGROUND ART

Along with the recent inclination toward multifunction, miniaturized and light-weight electronics, patterns of wiring circuit have been highly integrated, and multiple pins and narrow-pitched fine patterns have been employed in the field of semiconductors. In view of the fine patterns of circuits, anisotropic conductive films have been used to connect plural conductor patterns formed on a substrate with patterns of a conductor to be connected therewith or with IC or LSI. An anisotropic conductive film is a film which shows electrical conductivity in a certain direction alone, and is electrically insulated in other directions.

An anisotropic conductive film can be produced by dispersing conductive fine particles in an adhesive film, or forming through-holes in an adhesive film and filling the holes with a metal by plating.

The anisotropic conductive film can be made by the former method at low costs, but has a shortcoming in that it has poor reliability of a narrow-pitched electrical connection, due to the addition of conductive fine particles to the adhesive film.

In contrast, the latter method provides high reliability of a narrow-pitched electrical connection by forming through-holes with high precision, but is costly due to the complicated and time-consuming steps of perforation and filling of the metal.

DISCLOSURE OF THE INVENTION

It is therefore and object of the present invention to solve the above-mentioned problems and provide an anisotropic conductive film capable of establishing electrical connection at a narrow pitch, maintaining strength in the film surface direction that has not been achieved so far, and improving the adhesion to the objective substance, as well as a preferable production method thereof.

This object has been achieved by forming, on a metal thin wire, a coating layer made from an insulating material, winding said wire around a core member in a roll-like manner, heating and/or pressurizing the wires to weld and/or pressure-weld the coating layers to each other, and cutting the roll-like product in the width direction.

The anisotropic conductive film of the present invention characteristically provides the following.

(1) An anisotropic conductive film comprising an area A comprising a film substrate made from a first insulating material and plural conductive paths made from a conductive material, and an area B adjacent to the area A in the direction extending from the plane of the area A, the area B being made from an insulating material, having the same thickness as the area A, having a shape including a rectangle (0.2 mm×1 mm) and being free of a conductive path, the conductive paths being insulated from each other and piercing the film substrate in the thickness direction, each conductive path having both ends thereof exposed at the both surfaces of the film substrate, and the surface of the path except the exposed both ends being covered with a second material, and at least one of the first insulating material and the second material being an adhesive material, which is produced by the steps of (a) winding an insulated conductor wire around a core member to give a roll-like product, (b) heating and/or pressurizing the roll-like product to allow welding and/or pressure-welding of the coating layers, and (c) cutting the roll-like product in a predetermined film thickness along the plane that crosses the wound insulated conductor wire, the plane forming an angle with the conductor wire, wherein the core member cut together with the insulated conductor wire is used as a part of a product and this core member is the above-mentioned area B.

(2) The anisotropic conductive film of the above (1), wherein the conductive material is a metallic material.

(3) The anisotropic conductive film of above (2), which is produced by the steps of (a) forming a coating layer made from the second material on a metal thin wire, (b) forming a coating layer made from the first insulating material thereon to give an insulated conductor wire, at least one of the first insulating material and the second material being an adhesive material, (c) winding the insulated conductor wire around a core member to give a roll-like product, (d) heating and/or pressurizing the roll-like product to allow welding and/or pressure-welding of the coating layers made from the first insulating material, and (e) cutting the roll-like product in a predetermined film thickness along the plane crossing the would insulated conductor wire, the plane forming an angle with the conductor wire.

(4) The anisotropic conductive film of the above (1), having a modulus of elasticity of the above-mentioned area A of 1–20000 MPa.

(5) The anisotropic conductive film of any of the above (1) to (3), having a coefficient of linear expansion of the above-mentioned area A of 2–100 ppm.

(6) The anisotropic conductive film of any of the above (1) to (3), wherein the adhesive material is a thermoplastic adhesive material or a heat curable adhesive material.

(7) The anisotropic conductive film of any of the above (1) to (3), wherein at least one of the conductive paths has at least one end projected or recessed from the plane of the film substrate.

(8) The anisotropic conductive film of any of the above (1) to (3), wherein the conductive paths form an angle with the line perpendicular to the plane of the film substrate.

(10) The anisotropic conductive film of the above (1), wherein the area B surrounds the outer periphery of the area A, or the outer periphery of the area B is surrounded by the area A, or the area B divides the area A into two.

(11) The anisotropic conductive film of the above (10), wherein the outer periphery of the area B is surrounded by the area A, the shape of the area B being a circle, and ellipse, a regular polygon, a rectangle, a rhomboid or a trapezoid.

The production method of the present invention characteristically provides the following.

(A1) A method for producing an anisotropic conductive film, comprising the steps of (a) winding an insulated conductor wire around a core member to give a roll-like product, the insulated conductor wire comprising a wire made from a conductive material and at least two coating layers made from an insulating material, (b) heating and/or pressurizing the roll-like winding during the step (a) or after the step (a) to allow welding and/or pressure-welding of the coating layers of the wound insulated conductor wire to integrally form a winding block, and (c) cutting the winding block thus obtained in (b) in a predetermined film thickness along the plane crossing the wound wire, the plane forming an angle with the wound wire.

(A2) A method for producing an anisotropic conductive film, comprising the steps of (a) winding an insulated conductor wire around a core member to give a roll-like product, the insulated conductor wire comprising a wire made from a conductive material and at least one coating layer made from an insulating material, (b) heating and/or pressurizing the roll-like winding during the step (a) or after the step (a) to allow welding and/or pressure-welding of the coating layers of the wound insulated conductor wire to integrally form a winding block, and (c) cutting the winding block thus obtained in (b) in a predetermined film thickness together with the core member of the winding, along the plane crossing the wound wire, the plane forming an angle with the wound wire, wherein the core member cut together with the wire in step (c) is used as a product.

(A3) The method of the above (A1) or (A2) for producing an anisotropic conductive film, wherein the winding block obtained in the above step (b) is further molded with an insulating material and subjected to the above-mentioned step (c).

(A4) The method of above (A1) or (A2) for producing an anisotropic conductive film, said film comprising an area A comprising a film substrate made from a first insulating material, and plural conductive paths made from a conductive material, the conductive paths being insulated from each other and piercing the film substrate in the thickness direction, each conductive path having both ends thereof exposed at the both surfaces of the film substrate, and the surface of the path except the exposed both ends being covered with a second material, the method further comprising the step of making at least one end of at least one conductive path project or be recessed from the surface of the film substrate with respect to the area A of the anisotropic conductive film.

Figure 1A:
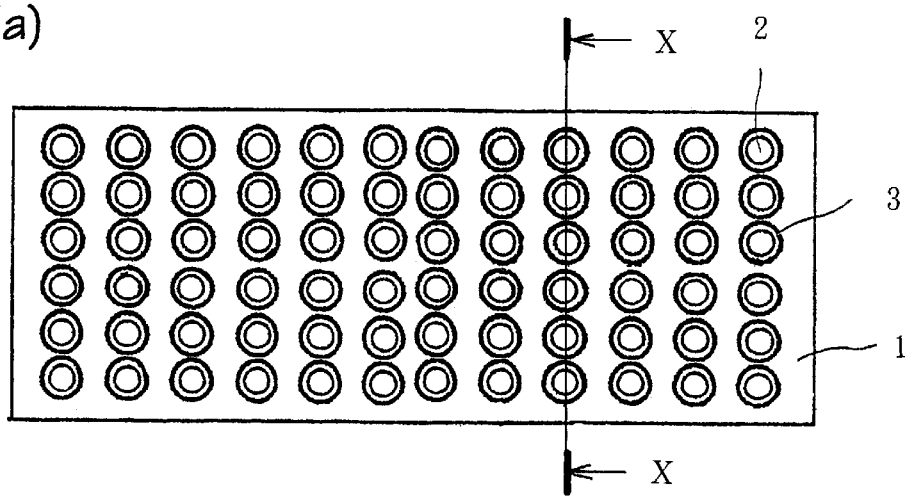
FIGS. 1(*a*)–1(*b*) are schematic views showing one embodiment of the anisotropic conductive film of the present invention.

The symbols used in the Figures mean the following.

1 film substrate
2 conductive path
3 coating layer
4 end of the conductive path
10 wire
11 coating layer
12 coating layer
13 insulated conductor wire

DETAILED DESCRIPTION OF THE INVENTION

Figure 1B:
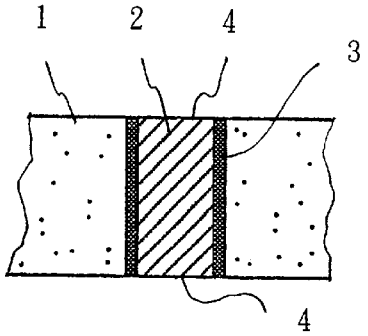

FIG. 1 includes schematic views showing one embodiment of the anisotropic conductive film of the present invention. FIG. 1(*a*) shows a film surface. FIG. 1(*b*) is a partially enlarged view of the section cut along the line X—X of the anisotropic conductive film shown in FIG. 1(*a*). In the embodiment shown in FIG. 1, plural conductive paths 2 made from a conductive material are arranged in a film substrate 1 made from a first insulating material, in such a manner that paths are insulated from each other and they pierce the film substrate 1 in the thickness direction. The both ends 4 of each conductive path 2 are exposed at the both surfaces of the film substrate. On the surface of the conductive path except the exposed both ends, i.e., side of the body of the conductive path 2, is formed a coating layer 3 made from a second material. At least one of the first insulating material and the second material is an adhesive material.

Figure 2A:
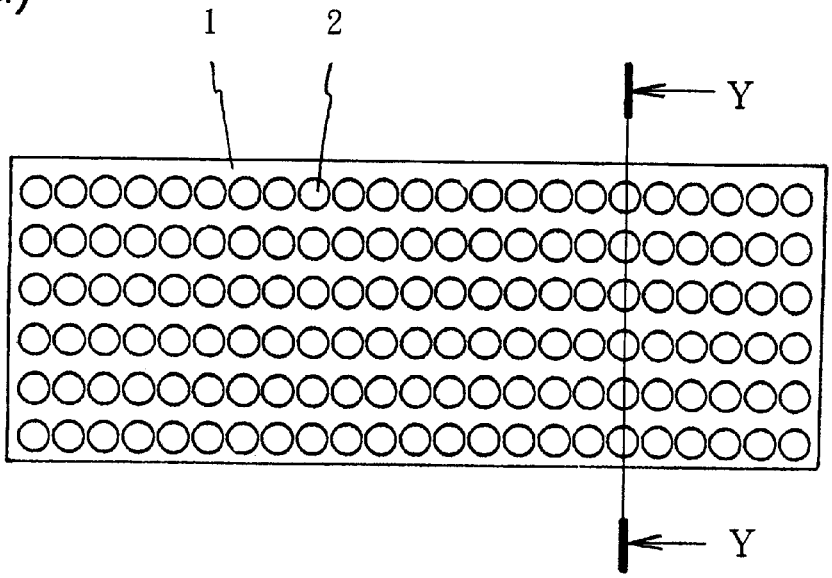
FIGS. 2(*a*)–2(*b*) are schematic views showing another embodiment of the anisotropic conductive film of the present invention.
Figure 2B:
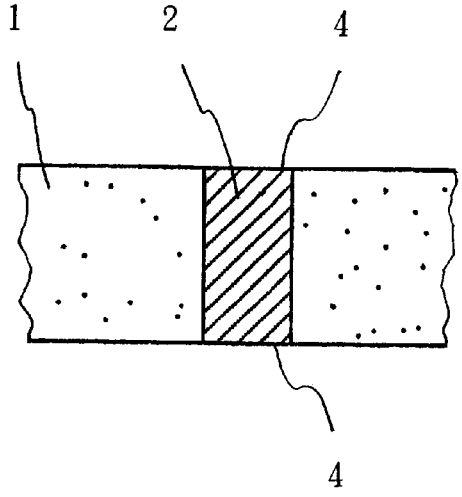

FIG. 2 includes schematic view showing another embodiment of the anisotropic conductive film of the present invention. FIG. 2(*a*) shows a film surface like FIG. 1(*a*). FIG. 2(*b*) is a partially enlarged view of the section cut along the line Y—Y of the anisotropic conductive film shown in FIG. 2(*a*). In the embodiment shown in FIG. 2, plural conductive paths 2 made from a conductive material are arranged in a film substrate 1 made from a first insulating material, in such a manner that paths are insulated from each other and they pierce the film substrate 1 in the thickness direction. The both ends 4 of each conductive path are exposed at the both surfaces of the film substrate. The embodiment is the same as that shown in FIG. 1 on this point, but the embodiment of FIG. 2 is characterized in that the side of the body of each conductive path is not covered with the second material and that the anisotropic conductive film has a coefficient of linear expansion of 2–100 ppm.

The first insulating material in the embodiments of FIGS. 1, 2 is exemplified by known materials used as a film substrate of an anisotropic conductive film. Preferred are the materials having adhesive property, since the anisotropic conductive film of the present invention is used for the adhesion of a printed board and a semiconductor element. The material having adhesive property may be a known adhesive material which may be a thermosetting resin or a thermoplastic resin. By the "adhesive material" is meant here a material having adhesive property as it is, or a material that does not show adhesive property as it is but is capable of adhesion upon heating and/or pressurizing. Examples thereof include a thermoplastic resin that is welded and/or pressure-welded by heating and/or pressurizing and a thermosetting resin which cures upon heating. Specific examples thereof include thermoplastic polyimide resin, epoxy resin, polyetherimide resin, polyamide resin, silicone resin, phenoxy resin, acrylic resin, polycarbodiimide resin, fluorocarbon resin, polyester resin, polyurethane resin and the like, which may be selected depending on the purpose of use. These resins may be used alone or in combination. When a circuit board and a semiconductor element are adhered using the anisotropic conductive film of the present invention and a thermoplastic resin adhesive is used as the first insulating material, reworking is possible, and when a thermosetting resin adhesive is used as the first insulating material, adhesion reliability at high temperatures can be advantageously enhanced. The appropriate selection of thermoplastic resin or thermosetting resin depends on the purpose of use of the inventive anisotropic conductive film.

These resins may contain various fillers, plasticizers and rubber materials depending on the use. The filler is exemplified by $SiO_2$ and $Al_2O_3$; the plasticizer is exemplified by TCP (tricresyl phosphate) and DOP (dioctyl phthalate); and rubber material is exemplified by NBS (acrylonitrile-butadiene rubber), SBS (polystyrene-polybutylene-polystyrene) and the like.

The conductive path to be formed in the film substrate is made from a conductive material. The conductive material may be a known material which is exemplified by a metallic material such as copper, gold, aluminum, nickel and the like and a mixture of these materials and an organic material such as polyimide resin, epoxy resin, acrylic resin, fluorocarbon resin and the like. This conductive material is appropriately selected according to the use of the inventive film. Preferred is a metallic material, particularly a good electrical conductor such as gold, copper and the like.

For the anisotropic conductive property of the film of the present invention, the conductive paths need to be disposed in a film substrate 1 in such a manner that the paths are insulated from each other and they pierce the film substrate 1 in the thickness direction, as shown in FIGS. 1, 2. Each conductive path 2 needs to have both ends 4 exposed at the both surfaces of the film substrate 1. By being "insulated from each other" is meant here the state wherein each conductive path is not in contact with other paths but independently stands in the film substrate.

The size and number of the conductive path in the film substrate are appropriately determined according to the use of the inventive anisotropic conductive film. For example, when the shape of the conductive path is columnar, as shown in FIGS. 1, 2, the diameter is preferably about 10–100 $\mu$m and the pitch is preferably about 10–100 $\mu$m. When each conductive path is too small or the number thereof is too less, the conductivity decreases, whereas when each conductive path is too large or the number thereof is too many, the strength of the inventive film reduces and the connection pitch cannot be made fine.

The section perpendicular to the axis of the conductive path 2 may have any shape as long as the above-mentioned conditions are met. It may be a column as shown in FIGS. 1, 2 or a polygonal column.

In the embodiment of FIG. 1, the surface of the conductive path 2 except the exposed both ends 4 is covered with a coating layer 3 made from a second material. In this case, the second material is subject to no particular limitation as long as it is an organic material known as an electronic material and may be insulating or noninsulating. When it is insulating, the above-mentioned first insulating materials can be also used, which may contain filler, plasticizer, various rubber materials and the like mentioned with regard to the first insulating material. The second material should be different from the first insulating material. Examples of the insulating material include polyimide resin, polyamidimide resin, epoxy resin, polyester resin and the like.

The anisotropic conductive film of the present invention is used for the adhesion of a circuit board and a semiconductor element. Therefore, at least one of the first insulating material and the second material needs to be an adhesive material. In view of an improved adhesive property, it is preferable that the both materials be adhesive materials. The second material may contain various fillers, plasticizers, rubber materials and the like used for the film substrate.

In the embodiment of FIG. 1, the conductive path 2 is covered with a coating layer 3, as a result of which the adhesion between the film substrate 1 and the conductive path 2, and the strength, heat resistance, dielectric characteristics and the like of the resulting anisotropic conductive film can be improved. Such effect is achieved by appropriately selecting the first insulating material and the second material.

For example, for better adhesion between the film substrate 1 and the conductive path 2, a polyetherimide resin is preferably used as the first insulating material and a polyamide resin is preferably used as the second material.

For a higher strength of the anisotropic conductive film, a polyimide resin is preferably used as the first insulating material and an epoxy resin is preferably used as the second material.

For a higher heat resistance of the anisotropic conductive film, a polyimide resin or a polycarbodiimide resin is preferably sued as the first insulating material and a polyester resin or a polyurethane resin is preferably used as the second material.

For superior dielectric characteristics of the anisotropic conductive film, a fluorocarbon resin is preferably used as the first insulating material and a polycarbodiimide resin is preferably used as the second material.

The modulus of elasticity of the anisotropic conductive film as a whole in the embodiments of FIGS. 1, 2 is preferably 1–20000 MPa, more preferably 10–2000 MPa, to alleviate the pressure caused by the connection with a semiconductor element and the like, and the stress produced by shrinkage/expansion due to changes in temperature after connection and the like. For this end, the modulus of elasticity of the first insulating material is 1–20000 MPa, more preferably 10–2000 MPa. When the conductive path 2 is covered with a coating layer 3, as in the embodiment of FIG. 1, the second material has a modulus of elasticity in view of stress relaxation of preferably 1–30000 MPa, more preferably 1000–20000 MPa.

The modulus of elasticity can be determined by measuring the modulus of elasticity at 125° C. using a viscoelasticity measuring apparatus.

In the embodiment of FIG. 1, the modulus of elasticity of the first insulating material and that of the second material preferably differ by 10 times or more. The modulus of elasticity differing by 10 times or more contributes to the alleviation of the stress in the film of the present invention, which in turn results in an enhanced film reliability. Either modulus of elasticity of these materials may be higher than the other, but in view of the stress relaxation, the modulus of elasticity of the first insulating material is preferably 10 times or more as high as that of the second material.

Specifically, the modula of elasticity of the above-mentioned materials are approximately 1000–5000 MPa for thermoplastic polyimide resin, 3000–20000 MPa for epoxy resin, 1000–4500 MPa for polyetherimide resin, 100–10000 MPa for polyamide resin, 10–1000 MPa for silicone resin, 100–4000 MPa for phenoxy resin, 100–10000 MPa for acrylic resin, 200–4000 MPa for polycarbodiimide resin, 0.5–1000 MPa for fluorocarbon resin, 100–10000 MPa for polyester resin, and 10–3000 MPa for polyurethane resin.

The modulus of elasticity of the anisotropic conductive film using the first insulating material and the second material can be made to fall within the above-mentioned range by selecting the above-mentioned materials and adding filler, rubber material and the like. As the filler and rubber material, those mentioned above can be used. When the material to be used is a thermosetting resin, curing conditions may be appropriately selected.

The anisotropic conductive film of the present invention has a coefficient of linear expansion of preferably 2–100 ppm, more preferably 16–50 ppm. When the coefficient of linear expansion is less than 2 ppm, the film becomes stiff and brittle whereas when it exceeds 100 ppm, the film undesirably has poor size stability.

The coefficient of linear expansion can be determined as an average coefficient of linear expansion at 25° C.–125° C. using a TMA measurement apparatus.

The anisotropic conductive film of the present invention has a thickness of preferably 25–200 $\mu$m, more preferably 50–100 $\mu$m. When the thickness is less than 25 $\mu$m, the anisotropic conductive film tends to have poor adhesive property, whereas when it exceeds 200 $\mu$m, the film has higher connection resistance, which is undesirable in terms of electric reliability.

In the anisotropic conductive film of the present invention, at least one end of at least one conductive path may be either projecting or recessed from the surface of the film substrate. These shapes of the contact points at the end make the anisotropic conductive film suitable for mounting a semiconductor element, connecting a flexible board and for use as various connectors.

Figure 3A:
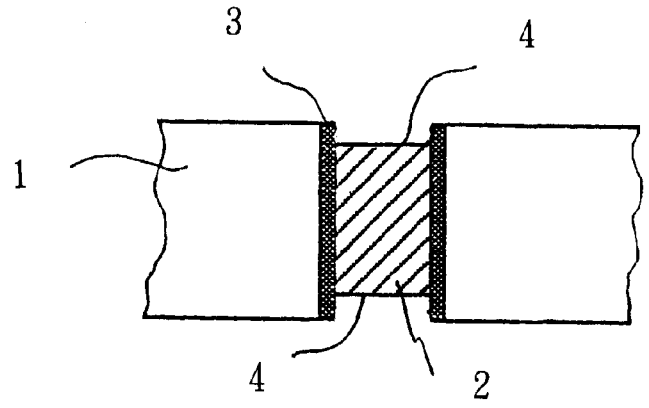
FIGS. 3(*a*)–3(*c*) are sectional views showing an end of a conductive path.
Figure 3B:
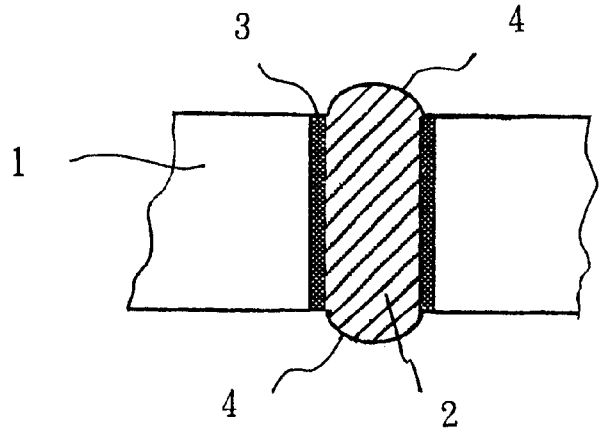
Figure 3C:
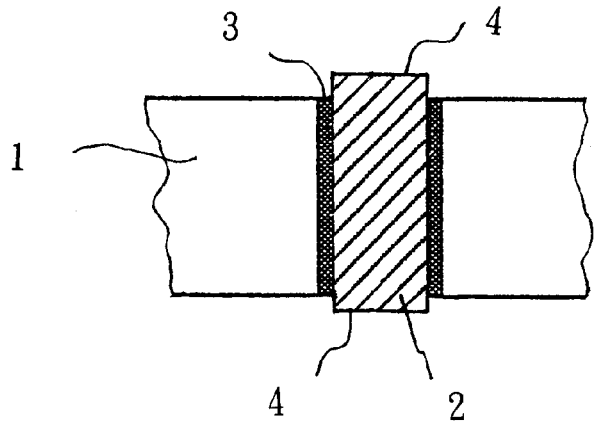

The end of the conductive path may be on the same plane with the film surface, as shown in FIG. 1(*b*), or a part or the entirety of the end 4 of the conductive path may project from the film substrate, as shown in FIGS. 3(*b*), (*c*), or may be recessed, as shown in FIG. 3(*a*). Each conductive path may have one end or both ends projected or recessed. Further, the entire surface of one end of the path or a predetermined part thereof may project, and the entire surface or a predetermined part thereof of the other end may be recessed. When the end of the conductive path projects from the film substrate, the projection may be a column having the same diameter as the conductive path, as shown in FIG. 3(*c*), a hemisphere typically known as the shape of a bump contact point, as shown in FIG. 3(*b*), and the like.

The conductive path can be projected from the film substrate in the embodiment of FIG. 2 by selectively removing the film substrate alone, or selectively removing the film substrate and the coating layer in the embodiment of FIG. 1. To be specific, wet etching using an organic solvent and dry etching such as plasma etching, argon ion laser, KrF excimer laser and the like are applied alone or in combination. The above-mentioned organic solvent can be appropriately determined depending on the film substrate and the material of the coating layer. Examples thereof include dimethylacetamido, dioxane, tetrahydrofuran, methylene chloride and the like.

The conductive path can be recessed from the surface of the film substrate by selectively removing the conductive path of the obtained anisotropic conductive film. To be specific, chemical etching using an acid or alkali is applied. Alternatively, the amount of the conductive material may be reduced when forming a conductive path by filling the hole with the material.

Figure 4:
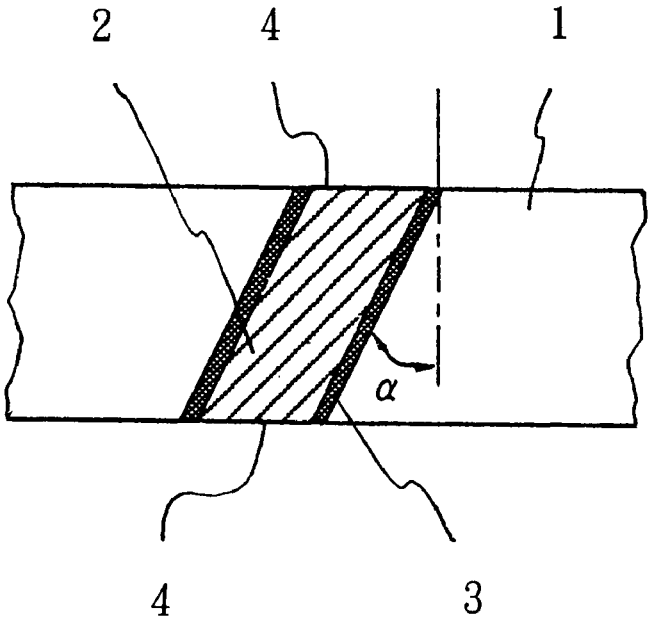
FIG. 4 is a sectional view showing an angle formed by a conductive path with a film surface.

The anisotropic conductive film of the present invention may have a conductive path 2 forming an angle $\alpha$ with the line perpendicular to the plane of the film substrate 1, as shown in FIG. 4. By this embodiment, even if a contact load is applied to the conductive path in the thickness direction of the sheet from an external contact object, the force is dispersed in the sheet, producing cushion effect, thereby preventing imperfect connection and improving contact reliability. For the cushion effect to be sufficiently exerted, the angle ($\alpha$ in FIG. 4) formed with the line perpendicular to the plane of the film substrate is preferably about 10°–45°.

Other preferable embodiments of the anisotropic conductive film of the present invention are explained in the following.

Figure 5A:
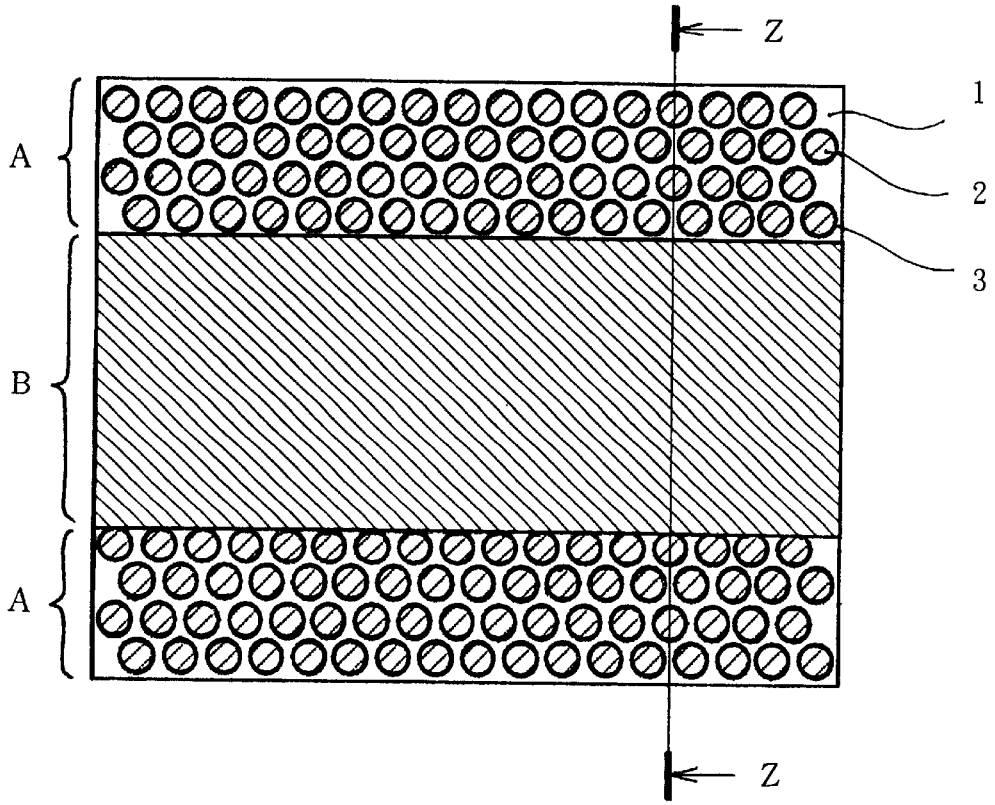
FIGS. 5(*a*)–5(*b*) a schematic views showing another preferable embodiment of the anisotropic conductive film of the present invention.
Figure 5B:
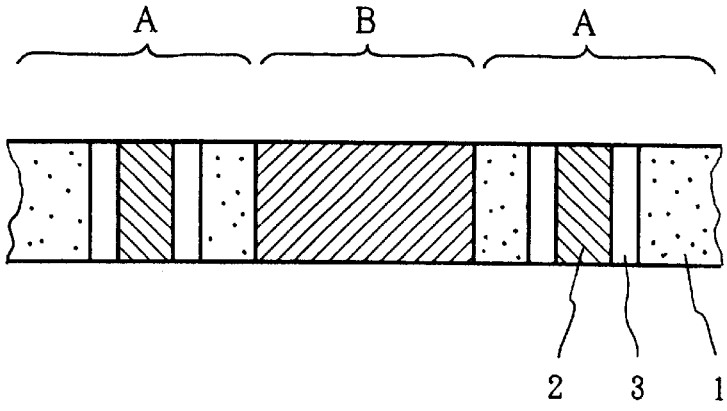

FIG. 5(*a*) shows the surface of a film and FIG. 5(*b*) shows a partial section of FIG. 5(*a*) cut along the line Z—Z. The embodiment shown in FIG. 5 contains a new part added to the embodiments shown in FIGS. 1, 2. To be specific, the anisotropic conductive film like the ones shown in FIGS. 1, 2 includes an area A (area designated by A in FIG. 5) containing plural conductive paths set therein and an area B (area designated by B in FIG. 5) adjacent to the area A in the direction extending from the plane of the area A, the area B optionally being made from an insulating material, having the same thickness as area A, having a shape including a rectangle of 0.2 mm×1 mm and being free of a conductive path.

The area B, when used for a semiconductor element as a contact target, for example, is formed to correspond to the part irresponsible for the contact with the element. As a specific example, when a 10 mm×10 mm square IC bare chip is the contact target, the conductor part (electrode pad) to make a connection with the external is disposed on the outer periphery bordering the square, and the central area of said IC is a circuit without contact point. When an anisotropic conductive film is used for such contact target, therefore, a part (area A) having anisotropic conductivity only need to be formed with respect to the part having a conductor part. The area B is preferably formed to correspond to other part formed in consideration of mounting on the mating part, such as adhesive property, flexibility (follow-up property, absorption of dimensional distortion, protection of the mating circuit) and the like.

When said anisotropic conductive film is used for the connection of a semi-conductor element with a circuit board, the two members do not wobble but can be adhered in a stable manner by combining the area A and the area B. Thus, peeling off seldom occurs, thereby affording high reliability that stands electrical connection.

The shape, material, positional relationship with area A and the like of the area B are explained later in connection with the production method.

A preferable production method of the anisotropic conductive film of the present invention is explained by reference to the production of the anisotropic conductive film shown in FIG. 1.

Figure 9A:
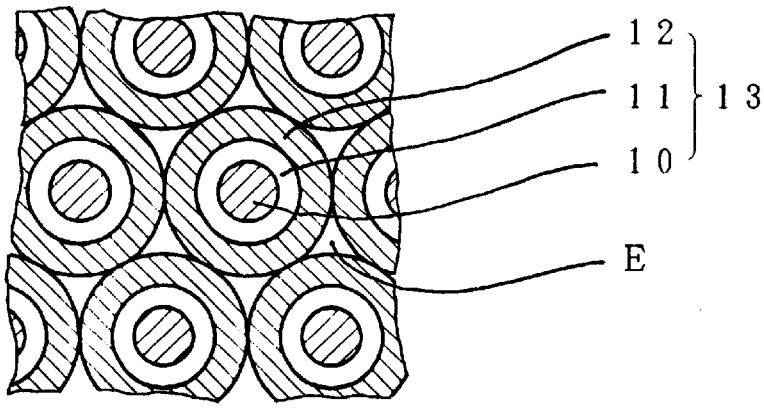
FIGS. 9(*a*) –9(*b* ) show preferable-methods for producing the anisotropic conductive film of the present invention.
Figure 9B:
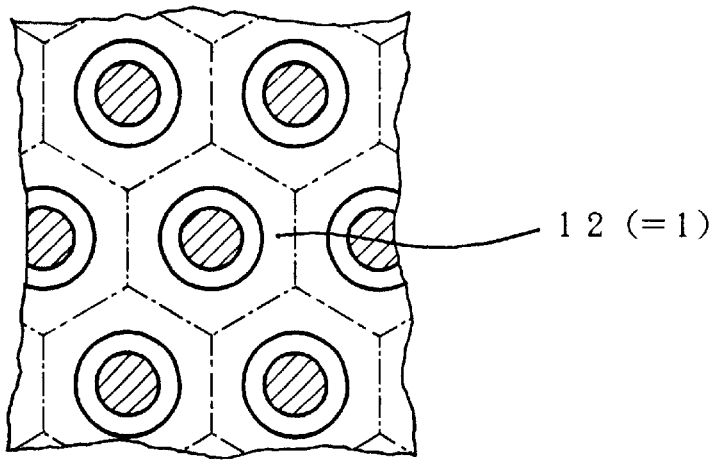

(1) As shown in the sectional view of an insulated wire in FIG. 9(*a*), on a wire 10 made from a conductive material are formed two coating layers 11 made from an insulating material (coating layer made from the second material) and 12 (coating layer made from the first material) by superimposing these coating layers, whereby an insulated conductor wire 13 is formed. In this embodiment, the coating layer includes two layers, but may include any number of layers on demand. In this case, the outermost layer is a coating layer made from the first material, and the other layer is a coating layer made from the second material. That is, the coating layer made from the second material may have plural layers. When plural coating layers made from the second material are to have tackiness, at least one layer of the plural layers needs to have tackiness, and which layer to impart tackiness is not limited.

This insulated conductor wire is wound around a core member to form a roll-like winding. FIG. 9(*a*) shows a sectional view wherein one insulated copper wire 13 is wound in a close-packed winding state. In FIG. 9(*a*), the areas of the wire 10 and coating layer 12 are hatched for easy identification. E is a space produced between wires.

(2) The winding under formation by winding as mentioned in the above (A) or the finished winding after winding of the above (A) is heated and/or pressurized to weld and/or pressure-weld the coating layers 12 of the insulated conductor wires adjacent to each other within or between layers to integrate the coating layers, whereby a winding block is formed. FIG. 9(*b*) is a schematic view showing insulated conductor wires integrated with each other, wherein the interface between the insulated conductor wires is shown with a dashed line. In the Figure, only wire 10 is hatched. In practice, the closely packed hexagons as shown in FIG. 9(*b*) may not be formed due to square matrix winding as shown in FIG. 1 or nonuniform winding, or the gap E between wires as shown in FIG. 9(*a*) may remain.

Figure 10:
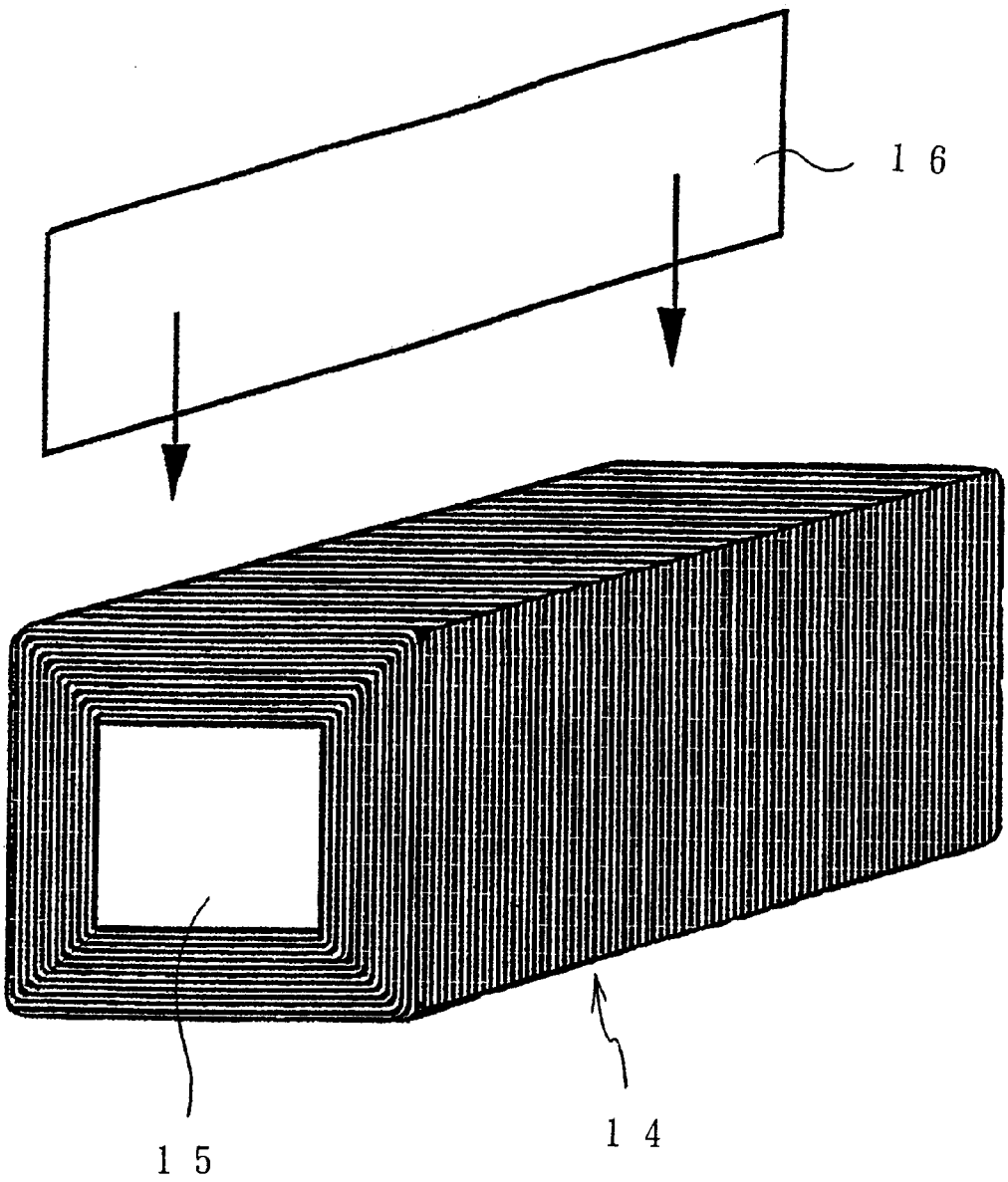
FIG. 10 shows a preferable method for producing the anisotropic conductive film of the present invention.

(3) As shown in FIG. 10, the winding block 14 obtained in the above (2) is sliced thin like a sheet to give the anisotropic conductive film of the present invention. Therein, 15 is a polygonal core member and 16 is a cutter for cutting. Whether to extract the core member before slicing, or to slice the core member together, or to separate the core member after slicing the core member together, or to combine a mole therewith can be freely determined according to the mode of the objective product. When slicing, the coil block is sliced along the plane crossing the coil at a certain angle and sliced in the objective film thickness.

The cutter to be used for cutting in FIG. 10 is depicted like a cooling knife for the explanation's sake. The present invention encompasses not only such an embodiment but also any cutting tool and server means. When one anisotropic conductive film is to be obtained from one winding block, it may be cut or ground from the both sides. The film surface is finished as necessary.

When the property of a material is stepwisely changed during the production of a conventional anisotropic conductive film, the direction of changes in the material has been mainly the direction of the film thickness, as is evident from the method used for this end, such as a method wherein plural film substrates are laminated, a method wherein a metal is precipitated and filled in the through-hole when forming a conductive path, and the like, and changes in different directions have been difficult to achieve. However, the production method of the present invention comprising at least the above-mentioned steps (1) to (3) can afford an anisotropic conductive film wherein the property of material changes in many stages in a concentric circle about the conductive path, namely, in the direction extending from the plane of the film.

In addition, the production method of the present invention, when compared to a conventional method wherein conductive fine particles are dispersed in an adhesive film, can produce a film having high reliability with regard to the narrow-pitched electrical connection. When compared to a conventional method wherein an adhesive film is perforated and a metal is filled in the holes by plating, the inventive method is free of the steps for perforation and filling of the metal, thereby enabling production at low costs.

When applying the production method of the present invention, the wire made from a conductive material is preferably a metal thin wire, with preference given to known wires having a strength permitting winding, such as a copper wire and the like. The thickness of the metal thin wire becomes the thickness of the conductive path, which is appropriately determined depending on the use of the anisotropic conductive film. Preferably, the diameter thereof is about 10–200 $\mu$m, more preferably 20 $\mu$m–100 $\mu$m.

A coating layer is formed on the surface of a bare wire by a conventionally known method, such as solvent coating (wet coating), weld coating (dry coating) and the like. The total thickness of the coating layer is appropriately determined according to the pitch between the conductive paths in the film surface of the objective anisotropic conductive film, i.e., number per unit area. Preferable thickness is 10–100 $\mu$m, which is more preferably 20–50 $\mu$m.

As shown in the steps shown in FIGS. 9(*a*), (*b*), the outermost layer (coating layer 12 in FIG. 9(*a*)) of the coating layer corresponds to the ground (base material) of the film substrate. In the embodiment of FIG. 1, for example, it corresponds to the first insulating material. When the embodiment shown in FIG. 2 is to be produced, therefore, the coating layer may consist of only one layer. The number of layers included in the coating layer can be determined freely according to the number of stages involved in changing the property when changes of the property of the material in the extending direction of the plane of the film is desired.

When winding, a known technique is utilized, which is used for manufacturing an electromagnetic coil (e.g., relay, transformer and the like), such as spindle method wherein a core member is rotated, flyer method wherein a wire is circled, and the like. The wire may be wound by a typical method of winding a single insulated conductor wire around a core member, a method of winding plural insulated conductor wires around a core member and the like. The winding is exemplified by turbulent winding by high speed rotation at wide feed pitch, and close-packed winding wherein a wire is closely wound by rotation at a comparatively low speed at a feed pitch of about the outer diameter of the wire, and accumulated on a lower layer wire, thereby forming a pattern of close-packed accumulation of winding blocks. The mode of winding can be determined freely depending on the wire size, cost, use and the like. An anisotropic conductive film obtained by close-packed winding has high quality in that the conductive paths are regularly and uniformly arranged.

The winding specifications such as winding width (entire length of bobbin in electromagnetic coil, which relates to the number of turns in one layer), thickness (related to the number of layers) and the like can be appropriately determined depending on the size of the objective anisotropic conductive film. When an ultrafine wire having an outer diameter of Ø40 μm is used, for example, the winding width is 50 mm–200 mm and the thickness is about 10 mm–30 mm.

The heating and/or pressurizing applied to the winding preferably comprise(s) processing of heating alone or processing of simultaneous heating and pressurizing, since certain level of tension has been applied during winding.

The heating temperature is appropriately determined depending on the material of the coating member of the outermost layer. It is generally from about softening point of the material to 300° C., which is specifically about 50–300° C. When a thermosetting resin is used as the material of the coating member of the outermost layer, a temperature lower than the curing temperature is employed for the heating. Pressing is done at preferably 1–100 kg/cm$^2$, more preferably about 2–20 kg/cm.

When a winding is heated and/or pressurized, the processing may proceed under reduced pressure to eliminate the air in the gaps between wires. When a winding block is prepared by winding a wire, air bubbles may be sequentially pressed out, thereby to prevent the air bubbles from entering the gaps between wires.

When the winding block is sliced into a thin sheet, its thickness corresponds to the thickness of the resulting film. Thus, by changing the slicing thickness, the thickness of the film can be set freely. This production method enables easy production of an anisotropic conductive film having a thickness of not less than 50 μm which has been so far difficult to produce.

By setting the direction of cutting the winding block, namely, the angle formed by the section of slice with the wire thus wound, the angle formed by the plane of the film substrate with the conductive path can be freely set. In the embodiments of FIGS. 1, 2, the angle formed by the section of slice with the wire thus wound is about 90 degrees. By changing this angle to other than 90 degrees, an anisotropic conductive film is obtained wherein a conductive path has an optional angle formed with the line perpendicular to the film substrate surface as shown in FIG. 4.

One of the preferable embodiments of the production method of the present invention is a method wherein, when a winding block is cut, the core member of the coil section is also cut together with the coil section and, without removing, the core member thus cut is also used as a product. By this method, the anisotropic conductive film of the embodiment of FIG. 5 can be easily obtained. That is, of the sections obtained by cutting the winding block, the section of the coil becomes area A and the section of the core member becomes area B.

The shape of the area B, i.e., sectional shape of the core member, is subject to no particular limitation and may be a circle, ellipse, regular polygon, rectangle, rhomboid, trapezoid and the like. The coil preferably has a core member such as a round rod and a square rod. Accordingly, the shape of the area B, when the entire winding block is cut along the central axis (rotation axis) of the core member, is typically square as shown in FIG. 5, and area B divides the area A into two.

Figure 6:
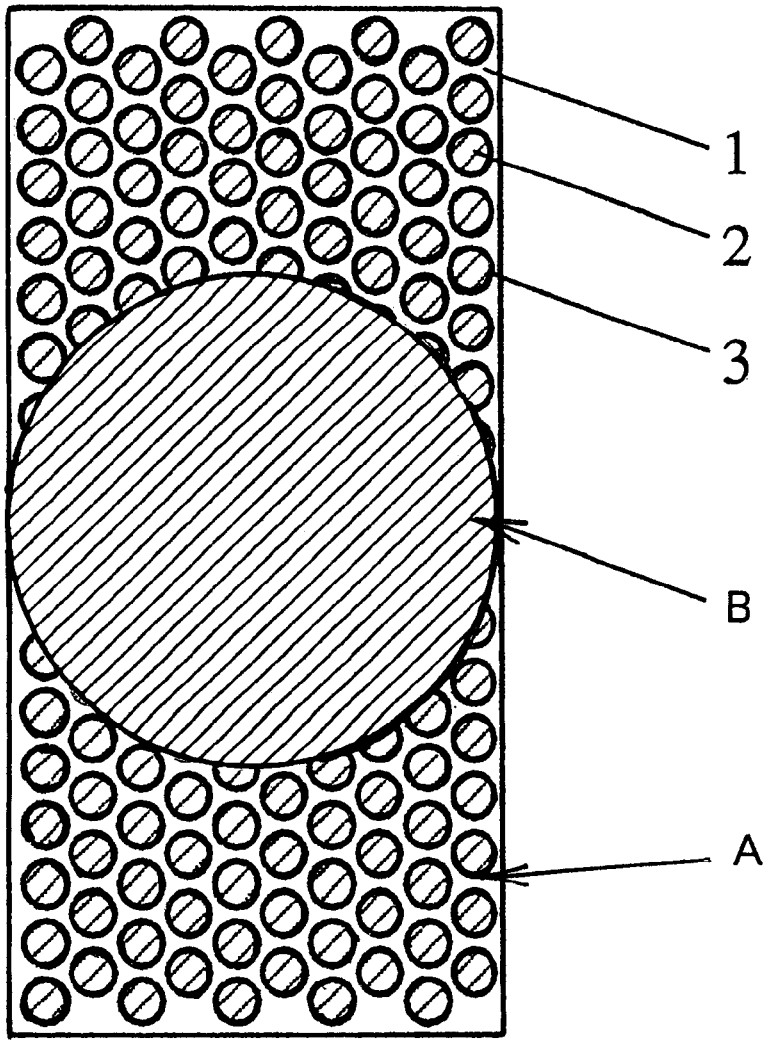
FIG. 6 shows on example of the shape of area B of the anisotropic conductive film of the present invention.

The shape of the core member may be a sphere besides a rod, in which case a brim is formed on both ends to enable winding. Therefore, the area B of the anisotropic conductive film obtained by cutting the winding block together with the core member becomes a circle as shown in FIG. 6.

Figure 7:
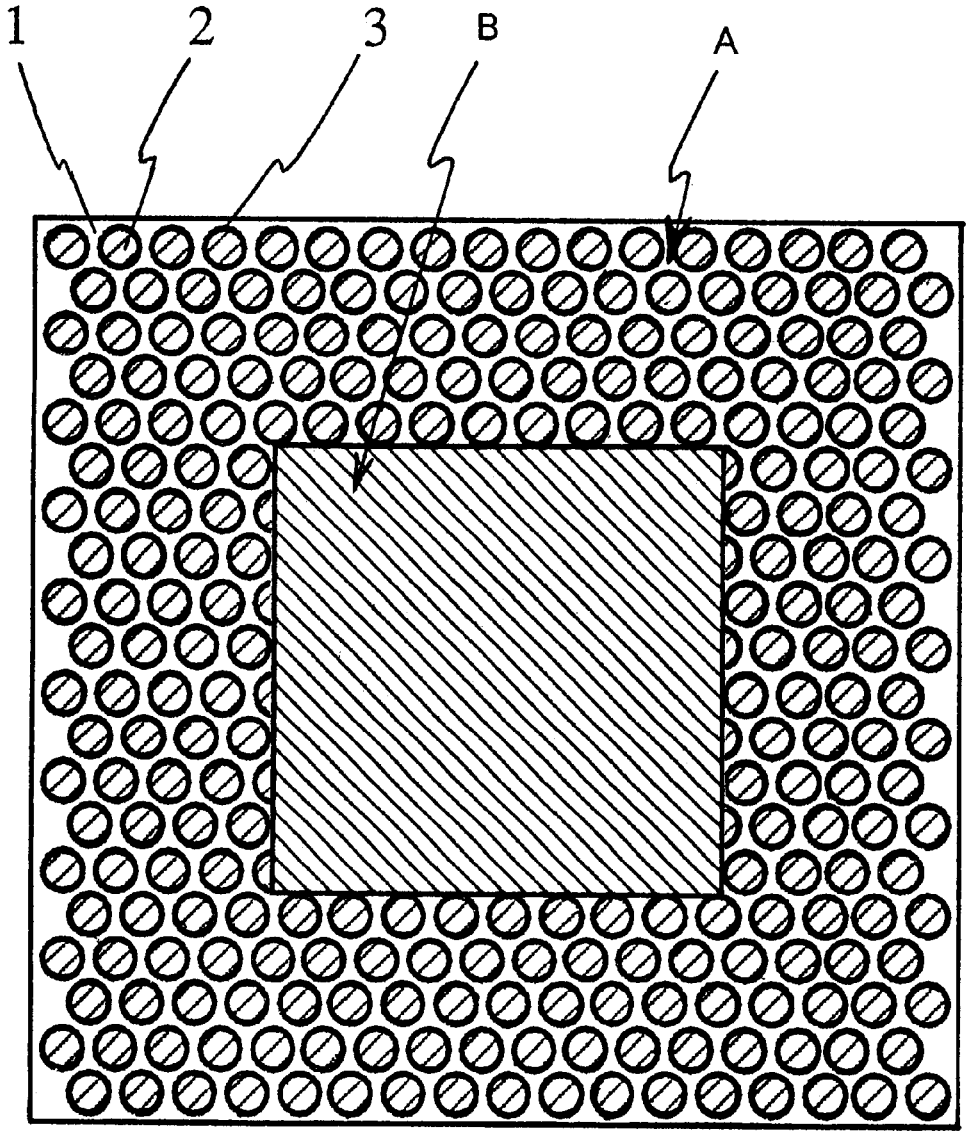
FIG. 7 shows one example of the positional relationship between area A and area B.

The embodiment shown in FIG. 7, wherein the area A surrounds the outer periphery of the area B, can be obtained by winding, as the second core member, the first winding block obtained by winding around the first core member, around the first winding block using, as the central axis of the second core member, the axis perpendicular to the middle point of the central axis of the first core member. In this way, a winding block including the first winding block can be obtained. By cutting this block along the plane including the both central axes of the first and the second core members, the embodiment of FIG. 7 can be obtained.

Figure 8:
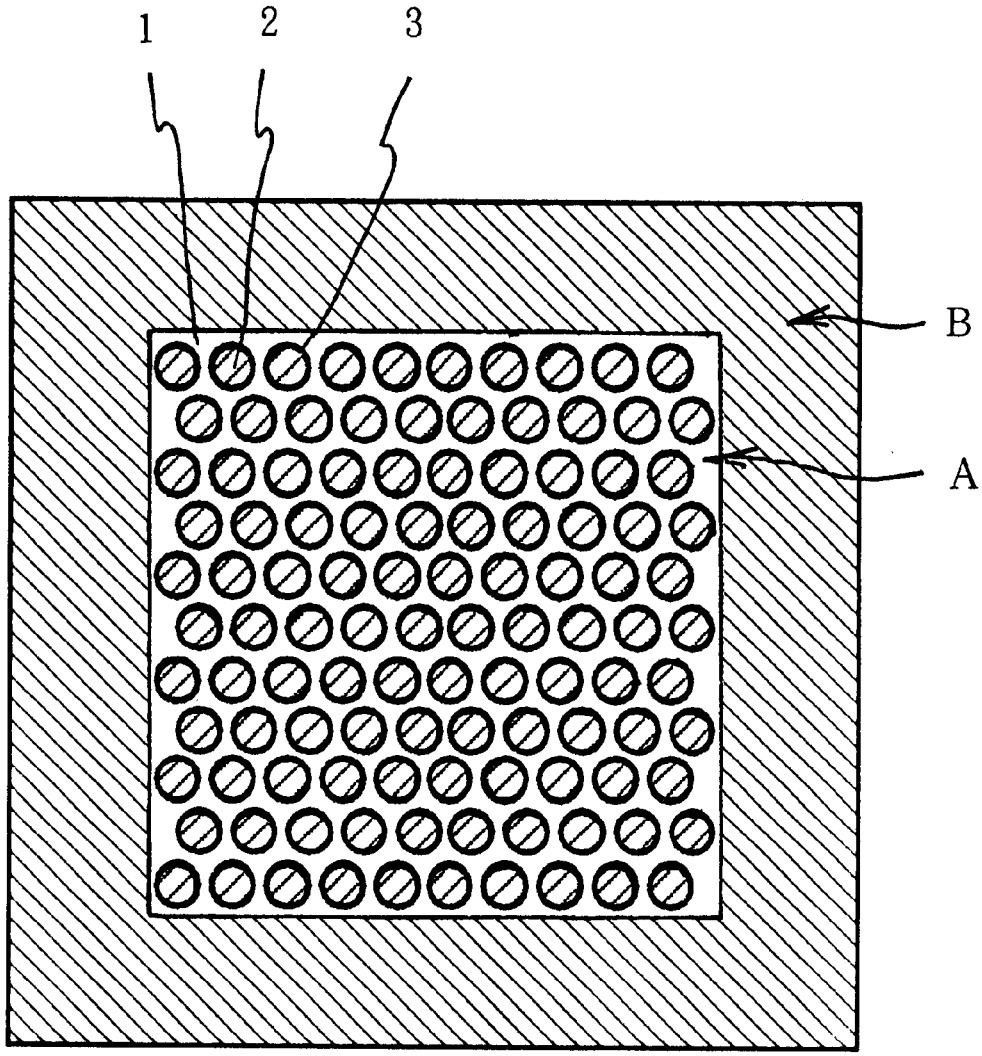
FIG. 8 shows one example of the positional relationship between area A and area B.

It is also possible to cut the block such that the area B surrounds the outer periphery of the area A as shown in FIG. 8, by molding or taping the entire winding block, with or without the core member, with a resin.

The material of the core member, namely, the material of area B, is not particularly limited, and metal materials having good theremoconductivity, such as copper, gold, aluminum, nickel and the like, plastic materials, the thermosetting and thermoplastic resins having adhesive property, which are exemplified as the material usable as the first insulating material in the present invention, and the like can be used. When an adhesive material is sued for area B, for example, the obtained anisotropic conductive film has superior adhesive property of a semiconductor element to a circuit board, and when a metal material is used, the film has superior heat releasability.

EXAMPLES

The present invention is explained in more detail in the following by way of Examples, wherein anisotropic conductive films were produced by the production method of the present invention.

Example 1

In this example, an anisotropic conductive film of the embodiment shown in FIG. 2 was prepared, wherein the number of coating layer formed on a metal thin wire was one. First, using a polyetherimide resin (Ultem—1000, manufactured by Japan Polyimide, modulus of elasticity 1000 MPa), a 25 μm thick coating layer was formed on a copper wire having an outer diameter of Ø35 μm to give an insulated conductor wire (total outer diameter Ø85 μm). Using a winding apparatus, the wire was sound regularly around a square columnar plastic core member [the entire length (winding width) 300 mm, sectional shape 30 mm×30 mm square] and the wires were closely packed to give a winding [average winding number per one layer 3500 turns, number of layers wound 150 layers (=thickness of layer about 12 mm)].

While heating to about 300° C., the obtained roll-like winding was pressurized at 60 kg/cm$^2$ to cause welding of polyetherimide resin, and then the coil was cooled to room temperature to give a winding block wherein the wound wires were integrated.

This winding block was sliced along the section perpendicular to the wire thus wound (the plane of the section parallel to the plane including the central axis of the plastic core member) to give sheets (film surface 300 mm×ca. 12 mm and thickness 10 mm), which are in the stage before anisotropic conductive films. The obtained sheets were further sliced thin and the outer diameter was standardized to give the anisotropic conductive film of the present invention (film surface 300 mm×12 mm, thickness 0.1 mm).

This anisotropic conductive film was subjected to the measurement of modulus of elasticity and coefficient of linear expansion of the anisotropic conductive film as a whole by TMA (thermomechanical analysis). As a result, modulus of elasticity was 1100 MPa and coefficient of linear expansion was 60 ppm.

Example 2

In the same manner as in Example 1 except that polyetherimide resin used as the material of the coating member was changed to polycarbodiimide resin (Carbodilite, manufactured by NISSHINBO INDUSTRIES, INC., modulus of elasticity 1700 MPa) and the temperature of heating the roll-like winding was changed to 100° C., the anisotropic conductive film of the present invention was obtained. The obtained anisotropic conductive film had a modulus of elasticity of 1800 MPa and a coefficient of linear expansion of 50 ppm.

Example 3

In the same manner as in Example 1 except that polyetherimide resin used as the material of the coating member was changed to fluorocarbon resin (ethylene tetrafluoride-hexafluoropropylene copolymer, modulus of elasticity 2 MPa) and the temperature of heating the roll-like winding was changed to 100° C., the anisotropic conductive film of the present invention was obtained. The obtained anisotropic conductive film had a modulus of elasticity of 2.1 MPa and a coefficient of linear expansion of 90 ppm.

Example 4

In this example, an anisotropic conductive film of the embodiment shown in FIG. 1 was prepared, wherein the number of the layers of the coating layer was two. On the surface of a copper wire (outer diameter Ø35 μm) was formed a 5 μm thick coating layer using an epoxy resin (Epikote YL980, Yuka Shell Epoxy Kabushiki Kaisha, modulus of elasticity 3000 MPa), on which a 25 μm thick coating layer was formed using a phenoxy resin (PKHM, Nippon Unicar Company Limited, modulus of elasticity 500 MPa). Using this insulated wire, a winding having the same winding specifications as a Example 1 was prepared. In the same manner as in Example 1 with regard to the subsequent steps except that the temperature of heating the roll-like winding was changed to 150° C., the anisotropic conductive film of the present invention was obtained. The obtained anisotropic conductive film had a modulus of elasticity of 30 MPa and a coefficient of linear expansion of 80 ppm.

Example 5

In this example, an anisotropic conductive film of the embodiment shown in FIG. 1 was prepared using a resin different from that used in Example 4, wherein the number of the layers of the coating layer was two. On the surface of a copper wire (outer diameter Ø35 μm) was formed a 5 μm thick coating layer using a silicone resin (manufactured by Toray•Dow Corning, JCR6115, modulus of elasticity 10 MPa). An epoxy resin (YL980) was used to form the outer coating layer. To said epoxy resin (100 parts by weight) was added silica (60 parts by weight) as a filler, thereby adjusting the modulus of elasticity to 20000 MPa. Using this epoxy resin, a 25 μm thick coating layer was formed on the above-mentionedfirst layer of the coating layer. Using this insulated wire, a winding having the same winding specifications as in Example 1 was prepared. In the same manner as in Example 1 with regard to the subsequent steps except that the temperature of heating the roll-like winding was changed to 100° C., the anisotropic conductive film of the present invention was obtained. The obtained anisotropic conductive film had a modulus of elasticity of 16000 MPa and a coefficient of linear expansion of 30 ppm.

The anisotropic conductive film obtained in Examples 1–5 had the following characteristics.

The anisotropic conductive film of Example 1 comprises a thermoplastic adhesive which can adhere instantaneously a circuit board and a semiconductor element by heating to 250° C. The use of the thermoplastic resin permits easy reworking.

The anisotropic conductive film of Example 2 comprises a thermosetting adhesive, with which a circuit board and a semiconductor element are adhered temporally by heating to 150° C., which is followed by heating at 200° C. for 3 hours for adhesion. The use of the thermosetting resin results in high adhesion reliability in a heat cycle test.

The anisotropic conductive film of Example 3 comprises a fluorocarbon resin adhesive which is a thermosetting adhesive having a low modulus of elasticity. If effectively alleviates the stress caused by the difference in the coefficient of linear expansion of a circuit board and a semiconductor element. Consequently, it shows high adhesion reliability in a heat cycle test.

The anisotropic conductive film of Example 4 comprises a conductive path having a coating layer of an epoxy resin formed thereon, and this coating layer enhances the adhesion between a copper wire and a film.

The anisotropic conductive film of Example 5 shows noticeably different modulus of elasticity between a film material and a coating layer material. Consequently, the stress in the film is alleviated and the film has high reliability in a heat cycle test.

Example 6

In this example, a winding block was cut together with the core member and, as shown in FIG. 5, an anisotropic conductive film containing the core member thus cut as the area B of the product was obtained. In the same manner as in Example 1 except that the shape and material of the core member were: entire length (winding width) 300 mm, sectional shape 8 mm×30 mm, polyimide article (Vespel manufactured by Toray•Du Pont) and the thickness of the winding layer about 2 mm (24 layers), a winding block, wherein the wound wires were integrated, was obtained.

This winding block having the core member in the center was sliced along the plane perpendicular to the wire and having the outer size of the core member of 300 mm×8 mm (the plane containing the axis of core member being one of the sections) as a sectional plane to give sheets. An anisotropic conductive film of the embodiment as shown in FIG. 5 was obtained, wherein the area containing the sections of the wires was area A and the section of the core member was area B, two areas A sandwiching the area B. The size of the anisotropic conductive film was two areas A: rectangles of 300 mm×ca. 2 mm, the area B: a rectangle of 300 mm×8 mm, and the entire size: 300 mm×12 mm, thickness 0.1 mm. The obtained anisotropic conductive film had a modulus of elasticity of 3000 MPa and a coefficient of linear expansion of 25 ppm.

Example 7

In the same manner as in Example 6 except that the material of the core member was copper, and anisotropic conductive film was obtained. The obtained anisotropic conductive film as a whole had a modulus of elasticity of 10 Gpa and a coefficient of linear expansion of 17 ppm.

Comparative Example 1

In this comparative example, an anisotropic conductive film was obtained by a conventionally known method comprising forming a number of through-holes in a film and precipitating metal to fill the through-holes by plating to give conductive paths. A polyimide film obtained by a known casting method was exposed to a KrF excimer laser light (oscillation wavelength 248 nm) to form 40 μm through-holes in the entirety of the film surface to achieve a closest packing arrangement (network arrangement including, as the minimum unit, an equilateral triangle with a through-hole on the vertex thereof). On the surface of this film was laminated a copper foil, and a resist layer was formed thereon. After washing with water, it was immersed in a gold cyanide plating bath at 60° C. with the copper foil exposed in the through-hole as a negative electrode, whereby copper was precipitated to fill the through-hole to give a conductive path 2A. As a result, an anisotropic conductive film as shown in FIG. 11(*b*) having an apparent structure similar to the embodiment of FIG. 2 was obtained.

The obtained anisotropic conductive film as a whole had a modulus of elasticity of 3000 MPa and a coefficient of linear expansion of 21 ppm.

Figure 11A:
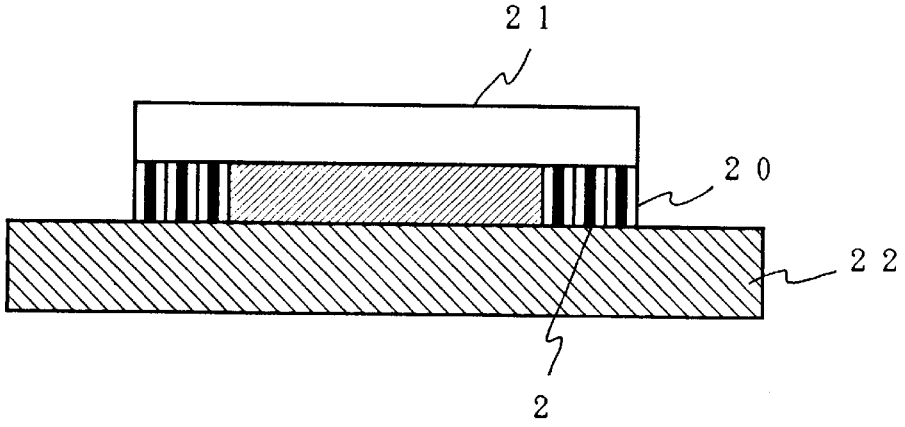
FIGS. 11(*a*)–11(*b*) show embodiments wherein semiconductor elements are connected to circuit boards using an anisotropic conductive film obtained according to the present invention and an anisotropic conductive film obtained according to a prior art technique.
Figure 11B:
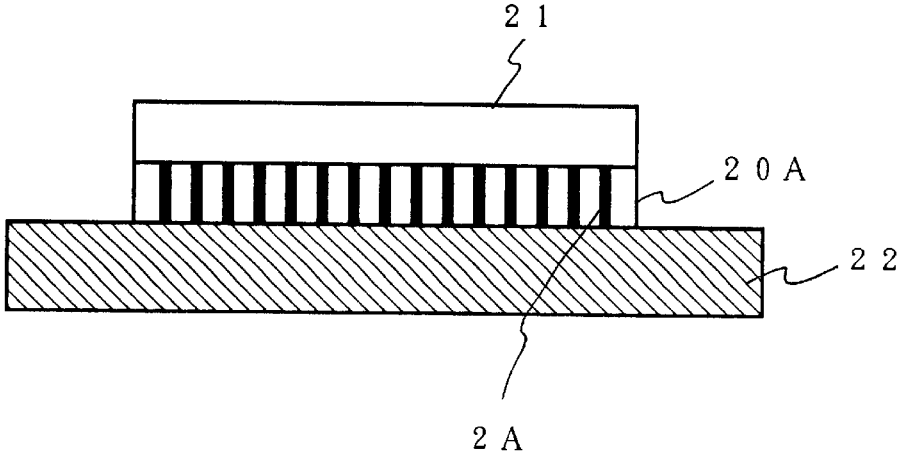

As shown in FIG. 11(*a*), the anisotropic conductive films 20 obtained in Examples 6, 7 were used to connect a semiconductor element 21 with a circuit board 22, whereby a semiconductor device was prepared. As shown in FIG. 11(*b*), the anisotropic conductive film 20A obtained in Comparative Example 1 was used to connect a semiconductor element 21 with a circuit board 22, whereby a semiconductor device was prepared.

These semiconductor devices (number of each sample 10) were subjected to TCT test, wherein from −50° C./5 min to 150° C./5 min was one cycle, to observe occurrence of peeling. As a result, peeling in the interface between the semiconductor element and the film was observed in 4 out of 10 samples of Comparative Example at about 400 cycles. Therefrom it is evident that the anisotropic conductive film of the present invention has superior adhesive property.

Industrial Applicability

As is clear from the above description, the present invention can provide an anisotropic conductive film having high reliability, which can stand narrow-pitched electrical connection, easily at low costs. It also enables production of an anisotropic conductive film having a thickness of 50 μm or above, which has been heretofore difficult or produce.

In an embodiment wherein a conductive path is covered with a coating layer, adhesion between a film substrate and a conductive path, strength, heat resistance and dielectric characteristics of the obtained anisotropic conductive film can be improved. In an embodiment comprising area A and area B, when the film is used for the connection of a semiconductor element and a circuit board, the two members do not wobble but can be adhered in a stable manner. Thus, peeling off seldom occurs even in repetitive environmental changes in, for example, heat cycles, thereby affording high reliability that stands electrical connection.

The production method of the present invention easily afforded these anisotropic conductive films.

This application is based on application Nos. 209542/1996 and 117244/1997 filed in Japan, the contents of which are incorporated hereinto by reference.

What is claimed is:

1. A method for producing an anisotropic conductive film, comprising the steps of (a) winding an insulated conductor wire around a core member to give a roll-like product, the insulated conductor wire comprising a wire made from a conductive material and at least two coatings layers made from an insulating material, (b) heating and/or pressurizing the roll-like winding during the step (a) or after the step (a) to allow welding and/or pressure-welding of the coating layers of the wound insulated conductor wire to integrally form a winding block, and (c) cutting the winding block thus obtained in (b) in a predetermined film thickness along the plane crossing the wound wire, the plane forming an angle with the wound wire.

2. The method of claim 1 for producing an anisotropic conductive film, wherein the winding block obtained in the above step (b) is further molded with an insulating material and subjected to the above-mentioned step (c).

3. An anisotropic conductive film comprising an area A comprising a film substrate made from a first insulating material and plural conductive paths made from a conductive material, and an area B adjacent to the area A in the direction extending from the plane of the area A, the area B being made from an insulating material, having the same thickness as the area A, having a shape and size capable of including a rectangle of 0.2 mm×1 mm and being free of a conductive path, the conductive paths being insulated from each other and piercing the film substrate in the thickness direction, each conductive path having both ends thereof exposed at the both surfaces of the film substrate, and the surface of the path except the exposed both ends being covered with a second material, and at least one of the first insulating material and the second material being an adhesive material, which is produced by the steps of (a) winding an insulated conductor wire around a core member to give a roll-like product, (b) heating and/or pressurizing said roll-like product to allow welding and/or pressure-welding of the coating layers, and (c) cutting the roll-like product in a predetermined film thickness along the plant that crosses the wound insulated conductor wire, the plane forming an angle with the conductor wire, wherein the core member cut together with the insulated conductor wire is used as a part of a product and this core member is the above-mentioned area B.

4. The anisotropic conductive film of claim 3, wherein the conductive material is a metallic material.

5. The anisotropic conductive film of claim 4, which is produced by the steps of (a) forming a coating layer made from the second material on a metal thin wire, (b) forming a coating layer made from the first insulating material thereon to give an insulated conductor wire, at least one of the first insulating material and the second material being an adhesive material, (c) winding said insulated conductor wire around a core member to give a roll-like product, (d) heating and/or pressurizing said roll-like product to allow welding and/or pressure-welding of the coating layers made from the first insulating material, and (e) cutting the roll-like product in a predetermined film thickness along the plane crossing the wound insulated conductor wire, the plane forming an angle with the conductor wire.

6. The anisotropic conductive film of any of claims 3 to 5, having a modulus of elasticity of the area A of 1–20000 MPa.

7. The anisotropic conductive film of any of claims 3 to 5, having a coefficient of linear expansion of the area A of 2–100 ppm.

8. The anisotropic conductive film of any of claims 3 to 5, wherein the adhesive material is a thermoplastic adhesive material or a heat curable adhesive material.

9. The anisotropic conductive film of any of claims 3 to 5, wherein at least one of the conductive paths has at least one end projected or recessed from the plane of the film substrate.

10. The anisotropic conductive film of any of claims 3 to 5, wherein the conductive path forms an angle with a line perpendicular to the plane of the film substrate.

11. The anisotropic conductive film of claim 1, wherein the area B surrounds the outer periphery of the area A, or the outer periphery of the area B is surrounded by the area A, or the area B divides the area A into two.

12. The anisotropic conductive film of claim 11, wherein the outer periphery of the area B is surrounded by the area A, the shape of the area B being a circle, an ellipse, a regular polygon, a rectangle, a rhomboid or a trapezoid.

13. A method for producing an anisotropic conductive film, comprising the steps of (a) winding an insulated conductor wire around a core member to give a roll-like product, the insulated conductor wire comprising a wire made from a conductive material and at least one coating layer made from an insulating material, (b) heating and/or pressurizing the roll-like winding during the step (a) or after the step (a) to allow welding and/or pressure-welding of the coating layers of the wound insulated conductor wire to integrally form a winding block, and (c) cutting the winding block thus obtained in (b) in a predetermined film thickness together with the core member of the winding, along the plane crossing the wound wire, the plane forming an angle with the wound wire, wherein the core member cut together with the wire in step (c) is used as a product.

14. The method of claim 13 for producing an anisotropic conductive film, wherein the winding block obtained in the step (b) is further molded with an insulating material and subjected to the step (c).

15. The method of claim 1 for producing an anisotropic conductive film, said film comprising an area A comprising a film substrate made from a first insulating material, and plural conductive paths made from a conductive material, the conductive paths being insulated from each other and piercing the film substrate in the thickness direction, each conductive path having both ends thereof exposed at the both surfaces of the film substrate, and the surface of the path except the exposed both ends being covered with a second material, the method further comprising the step of making at least one end of at least one conductive path project or be recessed from the surface of the film substrate with respect to the area A of the anisotropic conductive film.

16. The method of claim 1 for producing an anisotropic conductive film, wherein the plane crossing wound wire forming an angle in the step (c) forms an angle other than 90° with the wound wire.

17. The method of claim 13 for producing an anisotropic conductive film, said film comprising an area A comprising a film substrate made from a first insulating material, and plural conductive paths made from a conductive material, the conductive paths being insulated from each other and piercing the film substrate in the thickness direction, each conductive path having both ends thereof exposed at the both surfaces of the film substrate, and the surface of the path except the exposed both ends being covered wit ha second material, the method further comprising the step of making at least one end of at least one conductive path project or be recessed from the surface of the film substrate with respect to the area A of the anisotropic conductive film.

18. The method of claim 13 for producing an anisotropic conductive film, wherein the plane crossing the wound wire to form an angle in the above-mentioned step (c) forms an angle other than 90° with the wound wire.

* * * * *

UNITED STATES PATENT AND TRADEMARK OFFICE

CERTIFICATE OF CORRECTION

PATENT NO. : 6,245,175 B1
DATED : June 12, 2001
INVENTOR(S) : Yuji Hotta and Amane Mochizuki It is certified that error appears in the above-identified patent and that said Letters Patent is hereby corrected as shown below:

Title page,
Item [73], Assignee, please change "Tokyo (JP)" to -- Osaka (JP) --.

Signed and Sealed this

Sixteenth Day of April, 2002

*Attest:*

*Attesting Officer*

JAMES E. ROGAN
*Director of the United States Patent and Trademark Office*